United States Patent [19]

Onishi et al.

[11] Patent Number: 4,670,307

[45] Date of Patent: Jun. 2, 1987

[54] THERMAL TRANSFER RECORDING SHEET AND METHOD FOR RECORDING

[75] Inventors: Hiroshi Onishi, Hirakata; Hiroshi Esaki, Neyagawa; Tadao Kohashi, Moriguchi, all of Japan

[73] Assignee: Matsushita Electric Industrial Co., Ltd., Osaka, Japan

[21] Appl. No.: 738,178

[22] Filed: May 28, 1985

[51] Int. Cl.[4] ..... B41M 5/26

[52] U.S. Cl. ..... 427/261; 427/197; 427/202; 427/203; 427/265; 427/288; 428/195; 428/200; 428/207; 428/212; 428/323; 428/484; 428/488.1; 428/913; 428/914

[58] Field of Search ..... 428/195, 207, 211, 484, 428/488.1, 488.4, 913, 914, 200, 212, 323; 427/197, 202, 203, 256, 261, 265, 288

[56] References Cited

U.S. PATENT DOCUMENTS 4,503,095 3/1985 Seto et al. ..... 428/488.4

*Primary Examiner*—Bruce H. Hess

*Attorney, Agent, or Firm*—Stevens, Davis, Miller & Mosher

[57] ABSTRACT

A thermal transfer recording sheet is produced by placing, on one side of a sheet-like heat-resistant substrate successively along the surface, one or more thermal transfer recording layers containing a recording material which contains a binder material and a coloring material and whose viscosity is lowered and controlled by temperature-raise recording control, so that transferability to recording medium is imparted, and a thermal transfer coating layer containing a hot-melt material which is miscible (compatible) with at least a part of said binder material.

The thermal transfer recording using said thermal transfer recording sheet is characterized by first subjecting the thermal transfer coating layer to temperature-raise recording control, forming a film of the hot-melt material on the surface of the recording material at least on a portion to which the recording material is transferred, and conducting thereon thermal transfer recording as usual. By this thermal transfer recording, the unevenness of transfer can be reduced and the recording sensibility can be improved.

6 Claims, 5 Drawing Figures

THERMAL TRANSFER RECORDING SHEET AND METHOD FOR RECORDING

BACKGROUND OF THE INVENTION

This invention relates to a thermal transfer recording sheet for conducting thermal transfer recording by utilizing a thermal head or the like and a method for the thermal transfer recording.

Well known, conventional thermal transfer recording sheets having a melt transfer temperature of about 60° C. are produced by forming a thermal transfer recording layer of about 4 μm in thickness composed of only a recording material prepared by using, as a binder material, a hot-melt material consisting of 20% by weight of carnauba wax, 40% by weight of ester wax, 10% by weight of mineral oil and 10% by weight of other adjuvants. This hot-melt binder material is mixed with 20% by weight of a pigment coloring material, on the surface of a sheet-like heat-resistant substrate such as polyethylene terephthalate (PET) film, condenser paper or the like having a thickness of about 7 μm, by a hot-melt coating method (see, for example, Y. Tokunaga and K. Sugiyama, "Thermal Ink-Transfer Imaging", IEEE Trans. on Electron Devices, vol. ED-27, pp. 218–222, 1980.).

A thermal transfer recording sheet produced by forming, on the surface of a sheet-like heat-resistant substrate such as polyethylene terephthalate (PET) film, condenser paper or the like having a thickness of 9 μm, a thermal transfer recording layer having an uneven surface by mixing a recording material which contains a binder material and a coloring material and whose viscosity is lowered and controlled by temperature-raise recording control with ink transfer helping particles having a melting or softening point higher than that of the aforesaid binder material and a particle size larger than the thickness of a layer made of the recording material is disclosed in T. Kohashi, H. Onishi and H. Esaki, Japanese Patent Application No. 227155/84 which has not yet been published.

Thermal transfer, using these thermal transfer recording sheets, is conducted, in general, by pressing the thermal transfer recording sheet on a recording medium (an image-receiving sheet) such as recording paper or the like, pressing a well-known thermal recording head on the reverse side of the sheet-like heat-resistant substrate, selectively subjecting the thermal transfer recording layer to temperature-raise recording control through the substrate sheet by means of the thermal recording head, and thereby melt-transferring an ink material to the recording medium.

In the case of a thermal transfer recording sheet produced by placing one or more thermal transfer recording layers composed of a recording material alone on the surface of a sheet-like heat-resistant substrate, the recording material is adhered and transferred to a recording medium only after melting of the binder material is completed from the sheet-like heat-resistant substrate side to the thermal transfer recording layer surface. In this case, the recording material melted in the direction of the thickness of the thermal transfer recording layer is adhered and transferred at once to the recording medium, and hence such a thermal transfer recording sheet is useful for binary density recording such as letters, figures and the like.

In this case, when attempts to transfer the method recording material to the same recording medium always in the same amount according to heat energy supplied by temperature-raise recording control, without causing unevenness of transfer is tried, the transfer is seriously influenced by unevenness of the contact between the recording medium and the thermal transfer recording layer. Since the recording material is melted and has a lowered viscosity, the unevenness of transfer is influenced mainly by the condition of surface of the recording medium on which transfer recording is conducted and by a definite pushing pressure at the time of the contact. However, when a thermal head is used for the temperature-raise recording control, the pushing pressure is preferably 2.0 kg/cm$^2$ or less because of a problem of the physical strength of the thermal head.

In the case of a thermal transfer recording sheet produced by placing one or more thermal transfer recording layers having an uneven surface formed by incorporating ink transfer helping particles into a recording material, on the surface of a sheet-like heat-resistant substrate, heat energy is supplied from the sheet-like heat-resistant substrate side, resulting in a lowering of the viscosity of the recording material in the sheet surface portion and in production of a recording material having a lowered viscosity on the surface of the ink transfer helping particles by heat conduction. These recording materials having a lowered viscosity penetrate along the surfaces of the ink transfer helping particles owing to their thermal expansion caused by the lowering of the viscosity and to capillarity between the ink transfer helping particles and the recording medium surface. They also adhere to the ink transfer helping particles and are transferred to a recording medium together with the ink transfer helping particles. Therefore, the amount of the transfer is continuous according to the degree of lowering of the viscosity of the recording material, namely, the heat energy supplied by temperature-raise recording control. Accordingly, continuous analogue gradation recording can be conducted by temperature-raise recording control. However, in this case, when attempts are made to transfer the recording material to the same recording medium always in the same amount according to heat energy supplied by temperature-raise recording control, without causing unevenness of transfer (including unevenness of recording density), the transfer is seriously influenced by unevenness of contact between the recording medium and the thermal transfer recording layer. In this case when particle size distribution of the ink transfer helping particles is constant, the unevenness of transfer is influenced mainly by the condition of surface of the recording medium on which transfer recording is conducted and by a definite pushing pressure at the time of the contact. However, also in this case, when a thermal head is used for the temperature-raise recording control, the definite pushing pressure is preferably 2.0 kg/cm$^2$ or less because of a problem of a physical strength of the thermal head.

Therefore, when these thermal transfer recording sheets are used, a surface-treated sheet such as calendered paper, coated paper, synthetic paper or the like should heretofore be used as a recording medium. In the case of paper for general use having a low surface smoothness, for example, a Beck smoothness of 500 seconds or less, the transfer is too uneven for many reasons, such as no transfer of a recording material to be transferred, etc.

Further, in the case of thermal transfer recording on previously conducted thermal transfer recording, such as color repetitive recording and the like, by use of these thermal transfer recording sheets, particularly when the same kind of the recording materials is used, the transfer is generally easier than transfer on the surface of a recording medium. Even if the surface smoothness of the recording medium is improved, intermediate tone and color reproducibility are deteriorated by excessive transfer of the recording material at the time of repetitive recording, so that unevenness of transfer is observed.

The quality of the resulting record is greatly lowered by these uneven qualities of transfer.

SUMMARY OF THE INVENTION

Figure 1:
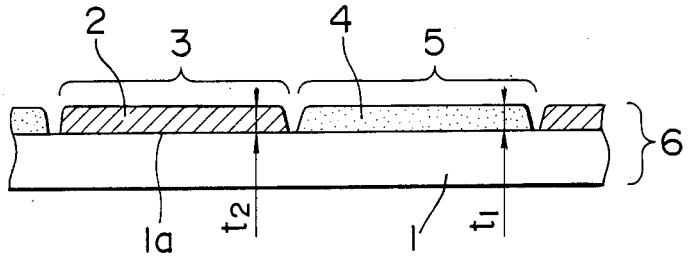
FIG. 1 is a cross-sectional structural view of one example of the thermal transfer recording sheet of this invention.

According to this invention, in order to solve the problems described above, a thermal transfer recording sheet is produced by placing, on one side of a sheet-like heat-resistant substrate successively along the surface, one or more thermal transfer recording layers containing a recording material which contains a binder material and a coloring material and whose viscosity is lowered and controlled by temperature-raise recording control, so that the transferability to recording medium is imparted, and a thermal transfer coating layer containing a hot-melt material which is miscible (compatible) with at least a part of said binder material.

Further, in conducting thermal transfer recording from the thermal transfer recording layers to a recording medium by subjecting the recording material contained in the thermal transfer recording layer to selective temperature-raise recording control, the recording is conducted by a thermal transfer method for recording characterized by subjecting the hot-melt material to temperature-raise recording control to conduct thermal transfer from the thermal transfer coating layer before conducting the thermal transfer recording, and thereby coating at least the whole or a part of the surface portion of the recording medium to which the recording material is transferred, with the hot-melt material.

DESCRIPTION OF THE INVENTION

In such a thermal transfer method for recording, before the recording material is thermally transferred to the surface of a recording medium, at least the whole or a part of the surface portion of the recording medium, to which the recording material is transferred, is coated with a hot-melt material miscible (compatible) with at least a part of the binder material contained in the recording material. Therefore, the smoothness of the surface portion of the recording medium is improved. Even when paper having a low smoothness, for example, paper having a Beck smoothness of 500 seconds or less is used as the recording medium, transfer recording can be conducted which suffers from less unevenness of transfer than thermal transfer recording directly on the recording medium. Further, since the binder material is miscible (compatible) with at least a part of the hot-melt material, the transfer of the recording material is facilitated; the recording sensibility is improved; the difference in transfer sensibility between recording on the surface of the recording medium and recording on the previously conducted thermal transfer recording, which difference is caused at the time of color repetitive recording, is reduced; unevenness of transfer due to excessive transfer of the recording material at the time of repetitive recording is relatively suppressed; and a record good in medium color tone and color reproducibility can be obtained.

In the thermal transfer recording using a thermal transfer recording sheet produced by placing, as described above, one or more thermal transfer recording layers containing a recording material and a thermal transfer coating layer containing a hot-melt material on one side of a sheet-like heat-resistant substrate successively along the surface, the hot melt material lowered in viscosity by temperature-raise recording control from the sheet-like heat-resistant substrate side to the thermal transfer coating layer containing the hot-melt material is thermally transferred to the surface portion of a recording medium, in which recording is to be conducted, to coat at least the whole or a part of the surface portion to which the recording material is to be transferred with the hot-melt material. Conventional thermal transfer recording is thereafter conducted while putting together the thermal transfer recording layer and the surface portion of the recording medium at least a part of which has been coated with the hot melt and in which recording is to be conducted, whereby a transfer record can be obtained. As a result, as described for the above mentioned method for recording, transfer recording can be conducted suffering from only slight unevenness of transfer, having an improved recording sensibility, and having good medium color tone and color reproduction recording at the time of overlapping recording. Moreover, temperature-raise recording control used for thermal transfer recording can serve also as temperature-raise recording control necessary for transfer of the hot-melt material by use of a conventional thermal transfer recording apparatus as it is, and another temperature-raise recording control is not necessary for transferring the hot-melt material.

This invention are illustrated below.

As the recording material in this invention, in the case of, for example, color recording of letters, pictures or the like, there can be used any of dye type alone, dye-binder type, pigment-binder type, and dye-pigment mixture-binder type recording materials. Needless to say, the dye and the pigment as coloring materials and the binder material may individually contain a plurality of materials, and the binder material itself may contain adjuvants such as surfactants, plasticizers, softening agents and the like. That is to say, the binder material in the recording material is interpreted as material other than the coloring material.

The binder material, constituting the recording material, should satisfy the condition that it is lowered in viscosity by temperature-raise recording control to be given transfer adhesiveness. Although it need not necessarily be solid at ordinary temperature (e.g., 25° C.), a hot-melt material which is solid at ordinary temperature is used from the viewpoint of the shelf life of transfer recording and thermal transfer recording sheet.

As the hot-melt material, there are used alone or in admixture two or more waxes such as, for example, candelilla wax, carnauba wax, bees wax, paraffin, microcrystalline wax and the like, low-molecular-weight polyethylenes, low-molecular-weight polystyrenes, vinyl polystearate, petroleum resins, polyamide resins, alicyclic saturated hydrocarbon resins, ethylene-vinyl acetate copolymer resins, resin-modified maleic acid resins, etc. From the viewpoint of transfer sensibility, the fastness of transfer record, and the like, the melting or softening point of the hot-melt material is selected and controlled so as to be 40° to 150° C., preferably 50° to 120° C. Similarly, as the softening agent incorporated in order to impart softness to the binder material, there are properly used, for example, polyvinyl acetate, cellulose esters, acrylic resins, stearic acid, lanolin, etc. in consideration of their melting or softening points. When, for example, a petroleum resin, a low-molecular-weight polystyrene or the like which itself is rich in softness is used as the binder material, a softening agent does not have to be added in some cases. Further, the lowering of viscosity by the rise in temperature and the transfer efficiency can be increased by incorporating the binder with an adhesive material which decreases in viscosity and increases in adhesiveness with the rise in temperature and is fluid at ordinary temperature. There can also be used, as the binder material, a hot-melt material whose thermal characteristics are adjusted by incorporating thereinto an adhesive material such as polybutene, polyisobutylene, polybutadiene, silicon oil or the like.

As the hot-melt material which is miscible with at least a part of the binder material constituting the recording material, the same materials as described above can be used. In this case, the hot-melt material may comprise a plurality of materials or the hot-melt material itself may be incorporated with adjuvants such as surfactants, plasticizers, softening agents and the like. In order to improve the miscibility (compatibility) with the binder, a material which is sufficiently miscible (compatible) with or is of the same kind as the material contained in the binder material is incorporated into at least the hot-melt material contained in the thermal transfer coating layer.

In addition, a record having a still better fixing can be obtained by improving the adhesion between the recording material and the recording medium by incorporating a material good in binding or adhesion to the recording medium into the hot-melt material. For materials good in adhesiveness to the recording medium, carnauba wax, montan wax, vinyl acetate resins, cellulose resins, polyvinyl alcohols and the like can be used, for example, when the recording medium is pulp paper such as ordinary woodfree paper or the like, while chlorinated polypropylenes (e.g., SUPERCHLON, a trade name, of Sanyo-Kokusaku Pulp Co., Ltd.), ethylene-vinyl acetate copolymer resins, acrylic resins, petroleum resins, alicyclic saturated hydrocarbon resins (e.g., ARCON, a trade name, of Arakawa Chemical Industries, Ltd.), etc. can be used when the printing medium is a film comprising polypropylene as its main constituent (e.g., PYLEN, a trade name, of Toyobo Co., Ltd.) or synthetic paper (e.g., YUPO, a trade name, of Oji Yuka Synthetic Paper Co., Ltd., and PEACHCOAT, a trade name, of Nisshinbo to Industries, Inc.).

The difference in thickness between concave and convex in the surface of calendered synthetic paper (e.g., YUPO, a trade name, of Oji Yuka Synthetic Paper Co., Ltd.) is about 0.5 μm, and that in the surface of ordinary woodfree paper (e.g., TOKKIBISHI, a trade name, of Mitsubishi Paper Mills, Ltd.) is about 15 μm. For at least reducing the difference in thickness between concave and convex, the thermal transfer coating layer should have a thickness substantially equal to the difference in thickness between concave and convex. However, if the thermal transfer coating layer is too thick, the heat energy supplied by temperature-raise recording control at the time of thermal transfer is required in a large amount and unevenness of transfer becomes liable to be caused. Therefore, a thickness of 0.5 to 15 μm is selected for a thermal transfer coating layer made of a hot-melt material alone.

As the coloring material constituting the recording material, organic or inorganic pigments and dyes used in conventional printing ink, paints and the like and mixed coloring materials thereof can properly selected and used. However, the coloring material preferably contains at least a pigment from the viewpoint of its light fastness.

As for a sheet-like heat-resistant substrate, there can be used, for example, resin films of polyethylene terephthalate, polyimide, cellophane, polycarbonate, triacetylcellulose, nylon or the like, or heat-resistant papers such as woodfree paper, glassine paper, tracing paper, condenser paper and the like which all have a thickness of about 3.5 to 15 μm, in view of heat conduction and mechanical strength.

The thermal transfer recording layers and the thermal transfer coating layer are formed on one side of a sheet-like substrate successively along the surface, for example, by a solvent coating method using a material liquid prepared by dissolving or dispersing the above-mentioned recording material or hot-melt material in a suitable solvent or by a hot-melt coating method comprising forming the layers while lowering the viscosity of each material by heating.

As for a sheet-like heat-resistant substrate, there can also be used those having a heat-resistant coating film or a lubricant layer formed on the side on which temperature-raise recording control is carried out; those having a resistant film layer formed in order to impart electrical conductivity, and those in which in order to improve the adhesion between the thermal transfer recording layer or the thermal transfer coating layer and the sheet-like heat-resistant substrate, a rough surface or an adhesive layer is formed on the contact surfaces by corona treatment, sand blasting or the like.

In the thermal transfer recording layer, an uneven surface can be formed by incorporating the recording material with ink transfer helping particles which have a higher melting or softening point than does the recording material and have a particle size larger than the thickness of the layer composed of the recording material.

As the ink transfer helping particles, either inorganic material particles or polymer material particles may be selected.

In selecting either of them, it is desirable to select a colorless, light-colored or white and transparent or semitransparent material in order to bring about no serious influence on the transfer record, particularly in color recording, and prevent inhibition of continuous gradation by adhesion and transfer of the ink transfer helping particles, and the shape of the particles should not necessarily be spherical.

Metal particles can also be used as the ink transfer helping particles. They have a high heat conductivity and are preferable from this point of view, but tend to undergo oxidation, corrosion and discoloration during storage of the thermal transfer recording sheet. Therefore, it is advisable to use nonmetallic particles.

The binder material comprising a hot-melt material usually has a specific heat of 0.5 to 0.8 cal/g·°C. and a heat conductivity of $(0.5-1)\times 10^{-3}$cal/cm·sec·°C.

Particles of inorganic materials such as alumina, glass, titanium oxide, calcium carbonate, silica, molten quartz and the like have a specific heat of 0.1 to 0.2 cal/g·°C. and a heat conductivity of $(2-50)\times 10^{-3}$cal/cm·sec·°C., namely, a lower specific heat and a higher heat conductivity than does the binder material. These particles permit effective formation of a molten recording material in the surface portion of the ink transfer helping particles. Since these particles have a much higher melting point (softening point) than that of the binder material, are not melted at the time of thermal transfer recording, and adhere to the recording medium to have a spacer effect, they are most frequently used.

In particular, alumina particles have a higher heat conductivity of about $5\times 10^{-2}$ cal/cm·sec·°C. and hence are the most suitable material.

As the ink transfer helping particles, there are used particles of thermosetting resins such as epoxy resins, benzoguanamine resins (e.g., EPOSTAR, a trade name, of Nippon Shokubai Kagaku Kogyo Co., Ltd.), phenol resins and the like; particles of thermoplastic resins such as ethylcellulose, polysulfones, nylon 12 resins (e.g., DAIAMID, a trade name, of Daicel Chemical Industries, Ltd.) and the like; etc. These particles have a specific heat of about 0.3 to 0.5 cal/g·°C. which is lower than that of the binder material, and a heat conductivity of $(0.2-1)\times 10^{-3}$ cal/cm·sec·°C. which is substantially equal to or lower than that of the binder material. The heat conductivity can be selected and adjusted in this wide range by selecting these materials.

The specific gravity of the ink transfer helping particles used in the thermal transfer recording layer ranges from 0.9 to 4 g/cm$^3$, namely from the low specific gravity of an organic resin to the high specific gravity of, for example, alumina. The usable range of particle size of the ink transfer helping particles satisfying the condition that the particle size is larger than that of the layer composed of the recording material is 1.5 to 40 μm and is particularly good in the range of 1.5 to 15 μm. The particle size of the coloring material is adjusted so as to be smaller than the layer thickness $t_1$ of the recording material. In the case of using a pigment as the coloring material, there exists a pigment having a particle size of 1.5 μm or more, considering from the distribution of particle size of pigment, if the thickness of the layer comprising the recording material is 1.5 μm or less. In this case, the pigment having a large particle size fulfil the role of ink transfer helping particles, so that further employment of other materials as ink transfer helping particles can be omitted.

The ink transfer helping particles may include particles having a particle size smaller than the thickness of the layer composed of the recording material if those having a particle size larger than said thickness exist judging from the distribution of particle size.

In the thermal transfer recording layer, the amount of the ink transfer helping particles incorporated into the recording material is preferably in the range of 2.5 to 230 parts by weight per 100 parts by weight of the recording material, and is controlled in this range.

The amount of the thermal transfer recording layer coated is preferably in the range of 0.5 to 6.5 g/m$^2$, and is selected in this range.

Particularly good continuous gradation transfer recording characteristics can be obtained under the following conditions; the ink transfer helping particles have a particle size distribution; the maximum of the distributed particle sizes is 15 μm or less; the average particle size (median value) is 2 to 5 μm; the amount of the ink transfer helping particles incorporated into the recording material is 2.5 to 230 parts by weight per 100 parts by weight of the recording material, as described above; and the amount of the thermal transfer recording layer coated is in the range of (0.5–4) g/m$^2$.

The thermal transfer recording layer can be formed, for example, by forming a material liquid prepared by dissolving or mixing a coloring material, a binder material and ink transfer helping particles in a solvent which can dissolve at least a part of the binder material contained in the recording material but cannot dissolve the ink transfer helping particles, into a layer having a predetermined thickness on the surface of a sheet-like heat-resistant substrate by a solvent coating method, then removing said solvent by evaporation, and thereby allowing at least a part of the ink transfer helping particles to protrude from the surface of layer of the recording material composed of the coloring material and the binder material to form an uneven surface.

In this case, the ink transfer helping particles may be thinly coated with the recording material.

In the thermal transfer coating layer, an uneven surface can be formed by incorporating the hot-melt material contained in said layer with ink transfer adjusting particles which have a higher melting or softening point than does the hot-melt material and have a particle size larger than the thickness of the layer made of the hot-melt material.

The thermal transfer coating layer is subjected to temperature-raise recording control to thermally transfer at least a part of the ink transfer adjusting particles together with the hot-melt material, whereby at least the whole or a part of the surface portion of the recording medium in which transfer is conducted is coated with the hot-melt material and the ink transfer adjusting particles. Between the two, the hot-melt material is used for, as described above, improving the transferability of the recording material to the recording medium surface and thereby attaining good intermediate tone and color reproduction recording at the time of repetitive recording. The ink transfer adjusting particles transferred to the recording medium form a uniform unevenness, according to their particle size distribution, on the recording medium surface smoothened by the hot-melt material.

When thermal transfer recording layer is composed of a recording material alone, the recording material is brought into contact first with the transferred ink transfer adjusting particles more frequently than contact with the recording medium surface or the previously transferred hot-melt material by properly adjusting the transfer rate of the ink transfer adjusting particles or the mixing ratio of the thermal transfer coating layer. The recording material, lowered in viscosity by temperature-raise coating control, is transferred mostly from the ink transfer adjusting particles. In this case, with the increase of the wettability to the ink transfer adjusting particles, the particles sink into the recording material in accordance with the viscosity of the recording material, so that the amount of the recording material transferred can be varied according to the viscosity. Since the viscosity of the recording material corresponds to heat energy supplied by temperature-raise recording control, an intermediate tone recording can eventually be obtained by the temperature-raise recording control.

When the thermal transfer recording layer is composed of a recording material and ink transfer helping particles, repetitive recording is carried out by conducting the subsequent transfer recording in a condition where the recording material and the ink transfer helping particles are present on the recording medium surface. In this case, the transfer sensibility is improved by the binder material contained in the recording material, and moreover gradation recording is conducted by the previously transferred ink transfer helping particles in the same manner as with the above-mentioned ink transfer adjusting particles, so that the sensitivity is further improved. Therefore, the difference between the gradation characteristic in such recording and that in monochromatic recording is large, and intermediate tone or color reproduction recording by repetitive recording has been not sufficient. However, since in this invention, ink transfer adjusting particles are incorporated, they are already present also in the surface portion of the recording medium and hence are equal to the previously transferred ink transfer helping particles in the repetitive recording, and the condition of recording portion surface in monochromatic recording always becomes substantially equal to that in repetitive recording. Accordingly, the difference between the gradation characteristics in repetitive recording and in monochromatic recording is at least reduced, and excessive transfer of ink is relatively suppressed also in repetitive recording merely by correcting the gradation in monochromatic recording, so that full-color recording good in color reproduction can be achieved.

Accordingly, when ink transfer adjusting particles are contained in the heat transfer coating layer, they are particularly effective when the thermal transfer recording layer contains ink transfer helping particles.

As for the ink transfer adjusting particles, either inorganic material particles or polymer material particles can be selected, as in the case of the ink transfer helping particles. The same materials as those described for the ink transfer helping particles can be used, but the material and the particle size need not be the same as in the case of the ink transfer helping particles and are properly selected.

Further, the ink transfer adjusting particles can be constituted, for example, by hot melt material particles of an organic resin such as rosin-modified maleic acid resin (for instance, having a melting point of 90° C.) or the like, or a wax such as carnauba wax (melting point: 83° C.), sasol wax (softening point: 108° C.) or the like.

However, the melting or softening point of the hot-melt material contained in the ink transfer coating layer is selected so as to be lower than that of these ink transfer adjusting particles.

The particle size of the ink transfer adjusting particles is selected so as to be 40 μm or less. When it exceeds 40 μm, the fixing by the hot-melt material becomes insufficient and the transferability of the ink transfer adjusting particles is lowered. Further, since, as described above, a thickness of 0.5 to 15 μm is selected for a layer made of a hot-melt material, the usable range of particle size of the ink transfer adjusting particles is 0.5 to 40 μm, and in particular, the range of 1.5 to 20 μm is good. Further, in this case, when the ink transfer adjusting particles include those having a particle size larger than the thickness $t_2$ of the layer made of a hot-melt material, they may also include those having a particle size smaller than the thickness $t_2$ of said layer. These particles influence the effect of temperature raise on the layer made of a hot-melt material.

In the thermal transfer coating layer, the amount of the ink transfer adjusting particles incorporated into the hot-melt material is preferably in the range of 6 to 500 parts by weight per 100 parts by weight of the hot-melt material, and is controlled in this range.

A particularly good record is obtained under the following conditions: the ink transfer adjusting particles have a particle size distribution; the maximum of the distributed particle sizes is 20 μm or less; the average particle size (median value) is 2 to 10 μm; and the amount of the ink transfer adjusting particles incorporated into the hot-melt material ranges from 10 to 400 parts by weight per 100 parts by weight of the hot-melt material.

Therefore, this range is particularly recommended.

The ink transfer adjusting particles may be thinly coated with the hot-melt material.

The thermal transfer coating layer can be formed, for example, by the same solvent coating method as with the thermal transfer recording layer containing ink transfer helping particles or by a method which comprises previously forming a hot-melt material into a layer on a sheet-like heat-resistant substrate by a hot melt coating or solvent coating method, scattering the ink transfer adjusting particles on the surface of the hot-melt material layer, and then, if necessary, burying them therein.

As to the number of the thermal transfer recording layers, one or more layers are needed for monochromatic recording, while a plurality of layers are needed for color recording. In the monochromatic recording, when one thermal transfer recording layer is used, it is placed alternately with the thermal transfer coating layer, in the longitudinal direction of the sheet-like heat-resistant substrate. A plurality of thermal transfer recording layers are used, for example, in the following case: a plurality of heat transfer recording layers made of individual recording materials of similar colors are placed one upon another, and repetitive recording are conducted to achieve intermediate tone recording. These thermal transfer recording layers and the thermal transfer coating layer are placed successively in picture frame sequence along the surface.

In the case of color recording, the coloring material contained in the recording material should have the three primary colors, i.e., cyan color, magenta color and yellow color, and at least three thermal transfer recording layers. Other words, four layers, inclusive of the thermal transfer coating layer, are placed on the surface of the sheet-like heat-resistant substrate in its longitudinal direction successively in picture frame sequence. Further, in color recording, four thermal transfer recording layers, inclusive of a recording material of a blackish color, may be used.

Examples of pigments suitable for the aforesaid alicyclic saturated hydrocarbon resin series binders are as follows: for black-color transfer recording carbon black is used, and in full-color transfer recording, for cyan color, Phthalocyanine Blue (CI Pigment Blue 15) is used; for magenta color, naphthol AS type monoazo pigment (CI Pigment Red 31) and carmine type pigment (CI Pigment Red 238) are used; and for yellow color, chrome phthale yellow pigment (CI Pigment Yellow 93), condensed azo yellow pigment and Benzidine Yellow G (CI Pigment Yellow 12) are used.

In general, as dyes, there can be used, for black color, CI Solvent Black 3; for cyan color, CI Solvent Blue 25; for magenta color, CI Solvent Red 49; and for yellow color, CI Solvent Yellow 16 and the like. Intermediate tone recording or color recording is conducted by carrying out repetitive transfer of recording matrials containing these pigments and dyes successively in picture frame sequence along the surface.

In the thermal transfer recording, the thermal transfer coating layer is first subjected to temperature-raise recording control in a condition where the thermal transfer coating layer containing a hot-melt material is pressed against the surface of recording medium onto which the recording material is to be transferred and recorded. The recording medium and the thermal transfer coating layer are separated from each other before the binding or adhering strength to the recording medium increases with a lowering of the viscosity of the hot-melt material contained in said layer, so that the hot-melt material returns to its initial solid state. Thus, the hot-melt material is thermally transferred to the surface of the recording medium: when the thermal transfer coating layer contains ink transfer adjusting particles, at least a part of the particles are also thermally transferred thereto. Next, the thermal transfer recording layer is pressed, as usual, against the portion coated with the hot-melt material of the recording medium surface, and the recording medium and the thermal transfer recording layer are separated from each other before the recording material lowered in viscosity by the temperature-raise recording control returns to its original solid state, whereby thermal transfer recording onto the recording medium. is carried out. In conducting repetitive recording, this thermal transfer recording is repeated on the same recording medium.

As the recording medium, there can be used papers such as woodfree paper, coated paper, synthetic paper and the like, or plastic films of polypropylene, polyethylene terephthalate and the like.

The temperature-raise recording control can be carried out by means of, for example, a thermal head; laser beam or the like which can be used because the thermal transfer recording sheet absorbs light; or in case of the sheet-like heat resistant substrate having an electric resistant film layer formed in order to impart electrical conductivity, other head having a multi-needle electrode and common electrode, which is used for supplying an electric current into the resistant film layer to utilize the Joule's heat.

For the thermal transfer recording sheet and the thermal transfer method for recording of this invention, concrete examples based on the constitutions described above are explained below referring to the drawings.

FIG. 1 is a cross-sectional structural view of one example of the thermal transfer recording sheet of this invention.

In FIG. 1, numeral 1 shows a sheet-like heat-resistant substrate, and on its surface 1*a* are formed a thermal transfer coating layer 3 composed of a hot-melt material 2 and a thermal transfer recording layer 5 composed of a recording material 4.

The thermal transfer coating layer 3 and the thermal transfer recording layer 5 are placed alternately on the sheet-like heat-resistant substrate 1, whereby there is produced a thermal transfer recording sheet 6 in which the thermal transfer recording layer 5 is single and which is used for monochromatic recording.

CONSTITUTION EXAMPLE 1

For example, a polyethylene terephthalate film (thickness: 9 μm) was used as the sheet-like heat-resistant substrate 1, and on its surface was formed the thermal transfer recording layer 5 by using, as the recording material 4, a so-called pigment-hot-melt binder type recording material for heat-melting transfer recording which had a melting point of about 70° C. and a layer thickness of about 4 μm and contained 20 parts by weight of carbon black, 20 parts by weight of carnauba wax and 40 parts by weight of ester wax as binder materials and about 20 parts by weight of oils and other additives as softening agents. The thermal transfer coating layer 3 was formed to a thickness of about 2 μm by using 70 parts by weight of a petroleum resin (e.g., NEOPOLYMER NP-120 (softening point: 120° C.), a trade name of Nippon Petrochemical Co., Ltd.) and 30 parts by weight of paraffin (melting point: 50°-52° C.), whereby the thermal transfer recording sheet 6 was produced.

Figure 2:
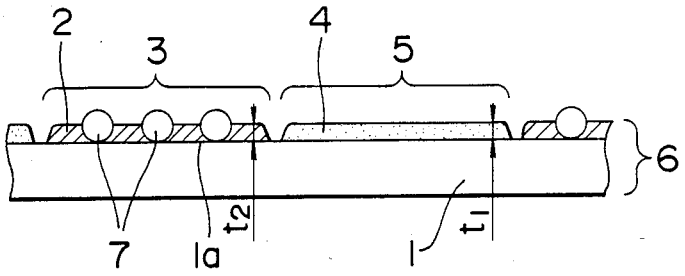
FIG. 2 is a cross-sectional structural view of another example of said thermal transfer recording sheet.

FIG. 2 is also a cross-sectional structural view of another example of the thermal transfer recording sheet of this invention.

FIG. 2 shows a thermal transfer recording sheet 6 used for monochromatic recording by single transfer recording in which a thermal transfer coating layer 3 composed of a hot-melt material 2 and ink transfer adjusting particles 7 incorporated into said material and a thermal transfer recording layer 5 composed of a recording material 4 are formed on a surface 1*a* of a sheet-like heat-resistant substrate 1 alternately in the longitudinal direction of the sheet-like heat-resistance substrate 1.

CONSTITUTION EXAMPLE 2

For example, a polyethylene terephthalate film (thickness: 9 μm) was used as the sheet-like heat-resistant substrate 1, and on its surface 1*a* was formed the thermal transfer recording layer 5 having a thickness of about 2 μm by using a recording material consisting of 50 parts by weight of the aforesaid alicyclic saturated hydrocarbon resin (softening point: 70° C.), 20 parts by weight of paraffin (ARCON P-70, melting point: 50°-52° C.) and 30 parts by weight of a cyan-color pigment (C.I. Pigment Blue 15). As the hot-melt material 2 contained in the thermal transfer coating layer 3, the aforesaid alicyclic saturated hydrocarbon resin (softening point: 70° C.) alone was used, and as the ink transfer adjusting particles 7 incorporated into the hot-melt material 2, 100 parts by weight of alumina (e.g., WA #4000, a trade name, of Fujimi Kenmazai Kogyo Co., Ltd.; average particle size 3 μm) was used. By dissolving or dispersing these hot-melt material and alumina in 400 parts by weight of xylene and applying the resulting material liquid by a solvent coating method, the heat transfer coating layer 3 of about 1.4 μm in thickness composed of the hot-melt material 2 was formed, whereby the thermal transfer recording sheet 6 was produced.

Figure 3:
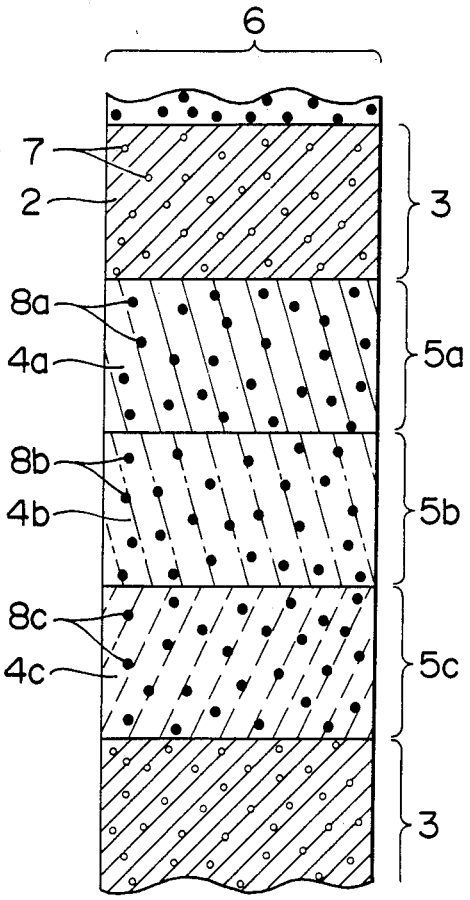
FIG. 3 is a structural view of still another example of said thermal transfer recording sheet.

FIG. 3 is also a structural view of further another example of the thermal transfer recording sheet of this invention.

FIG. 3 shows a thermal transfer recording sheet 6 in which a thermal transfer coating layer 3 composed of a hot-melt material 2 and ink transfer adjusting particles 7 incorporated into said material and thermal transfer recording layers 5*a*, 5*b* and 5*c* composed of recording materials 4*a*, 4*b* and 4*c*, respectively, and ink transfer helping particles 8*a*, 8*b* and 8*c*, respectively, incorporated into the respective materials, are placed successively in picture frame sequence along the surface in the longitudinal direction of the sheet-like heat-resistant substrate 1.

By use of this thermal transfer recording sheet 6, full-color recording can be conducted by selecting coloring materials of cyan, yellow and magenda type colors, respectively, which are the three primary colors, as coloring materials contained in the recording materials 4*a*, 4*b* and 4*c*, respectively, and subjecting individual recording materials 4*a*, 4*b* and 4*c* to repetitive recording successively in picture frame sequence along the surface. The order of repetitive recording of the recording materials 4*a*, 4*b* and 4*c* containing these respective coloring agents and the mixing ratios between the binder material and coloring materials in these recording materials can be properly selected. Materials for the ink transfer helping particles 8*a*, 8*b* and 8*c* contained in the thermal transfer recording layers 5*a*, 5*b* and 5*c*, respectively, their mixing ratios to the recording materials 4*a*, 4*b* and 4*c*, respectively, and their particle sizes (including average particle sizes and particle size distributions), can be properly selected for each component.

Although this figure shows the case where three kinds of thermal transfer recording layers 5*a*, 5*b* and 5*c* are placed, there can be similarly produced a thermal transfer recording sheet 6 in which four kinds of thermal transfer recording layers, inclusive of a thermal transfer recording layer containing a coloring material of a blackish color, are placed. On the other hand, when the thermal transfer recording layer is single, the thermal transfer coating layer 3 and the thermal transfer recording layer 5 are placed alternately in the longitudinal direction of the sheet-like heat-resistant substrate 1.

As shown in FIG. 3, the thermal transfer recording layers 5*a*, 5*b* and 5*c* contain the ink transfer helping particles 8*a*, 8*b* and 8*c*, respectively, but a thermal transfer recording layer containing none of these particles can be properly included in the group consisting of the thermal transfer recording layers 5*a*, 5*b* and 5*c*. The same applies to a thermal transfer recording sheet 6 containing a plurality of other thermal transfer recording layers.

The thermal transfer recording sheets 6 previously described in FIGS. 1 and 2 were illustrated for monochromatic binary density recording. In the case of the thermal transfer recording sheet 6 in which as shown in FIG. 3, a plurality of thermal transfer recording layers are placed, the individual thermal transfer recording layers and the thermal transfer coating layer 3 are placed, as shown in FIG. 3, on the surface 1*a* of the sheet-like heat-resistant substrate 1 successively in picture frame sequence along the surface in the longitudinal direction.

CONSTITUTION EXAMPLE 3

For example, a polyethylene terephthalate film (thickness: 9 μm) was used as the sheet-like heat-resistant substrate 1, and on its surface 1*a* was formed the thermal transfer recording layer 5*a* in which the recording material 4*a* was composed of 18.6 parts by weight of the aforesaid alicyclic saturated hydrocarbon (softening point: 70° C.), 9.3 parts by weight of candelilla wax, 11.1 parts by weight of paraffin (melting point: 50°–52° C.) and 24 parts by weight of a cyan-color pigment (C.I. Pigment Blue 15); the ink transfer helping particles 8*a* were composed of 30 parts by weight of alumina (described above); these materials were dissolved or dispersed in 240 parts by weight of xylene; and the ink transfer helping particles 8*a* were disposed in the recording material 4*a* having a thickness of about 1 μm. In the other thermal transfer recording layers 5*b* and 5*c*, a magenta-color pigment (C.I. Pigment Red-31) and a yellow-color pigment (C.I. Pigment Yellow-93) were used, respectively, as coloring materials, and each of the thermal transfer recording layers 5*b* and 5*c* was formed by employing the same mixing ratio and production process as with the thermal transfer recording layer 5*a*. In this case, the hot-melt material 2 contained in the thermal transfer coating layer 3 was composed of 50 parts by weight of the aforesaid alicyclic saturated hydrocarbon resin (softening point: 70° C.) and 20 parts by weight of paraffin (melting point: 50°–52° C.); 70 parts by weight of alumina (the same as described above, average particle size 3 μm) was used as the transfer adjusting particles 7; these materials were dissolved or dispersed in 280 parts by weight of xylene; and the thermal transfer coating layer 3 of about 1.2 μm in thickness made of the hot-melt material was obtained by a solvent coating method in the same manner as with the thermal transfer recording layers 5*a*, 5*b* and 5*c*. These thermal transfer recording layers 5*a*, 5*b* and 5*c* and thermal transfer coating layer 3 were formed on the afordsaid sheet-like heat-resistant substrate 1 successively in picture frame sequence along the surface, whereby the thermal transfer recording sheet 6 was produced.

Figure 4:
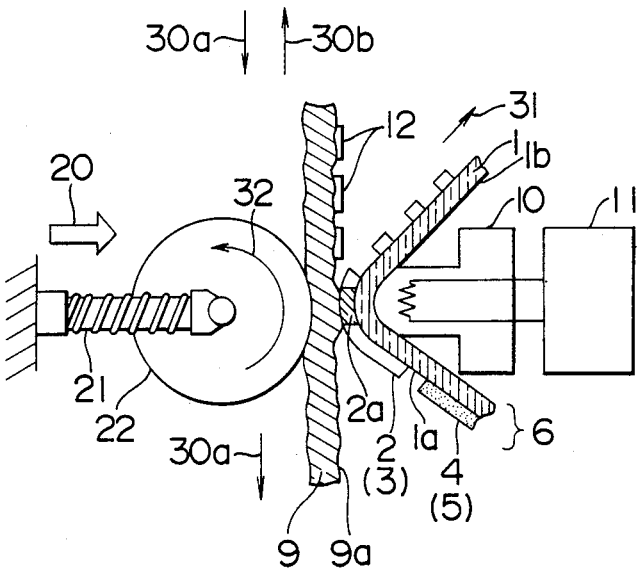
FIG. 4 is a cross-sectional constitutional view showing one example of the thermal transfer method for recording of this invention.

FIG. 4 shows one example of the thermal transfer method for recording of this invention.

In FIG. 4, as a thermal transfer recording sheet 6, there is used one in which as previously described in FIG. 1, a thermal transfer coating layer 3 made of a hot-melt material 2 and a thermal transfer recording layer 5 made of a recording material 4 are placed on a surface 1*a* of a sheet-like heat-resistant substrate 1 alternately in the longitudinal direction of the sheet-like heat-resistant substrate 1.

The thermal transfer recording in this example is conducted in the following manner.

A linear type thermal recording head 10 which carries out selective temperature-raise recording control according to recording signals given from a temperaturer-raise control driving circuit 11 is placed in contact with the reverse side 1*b* of the sheet-like substrate 1 of the thermal transfer recording sheet 6.

First, the thermal transfer coating layer 3 and a recording medium 9 are pressed against each other between a recording platen 22 and the thermal recording head 10 by means of a pushing pressure 20 produced by a pressing mechanism 21. While carrying out rotation of the recording platen 22 in direction of arrow 32, and paper sending and sheet sending in directions of arrows 30*b* and 31, the thermal transfer coating layer 3 is subjected to temperature-raise recording control at a definite temperature (heating rate) by means of the recording head 10 driven by definite unmodulated recording signals supplied from the circuit 11. The hot-melt material *2a*, lowered in viscosity by this temperature-raise recording control, is transferred to a printing medium surface *9a*. A hot melt material film 12 which is material of the thermal transfer coating layer 3 is uniformly transferred onto the surface *9a* at least over a portion of a desired recording image-plane size and according to all picture elements, whereby a smooth surface is formed.

Subsequently, the pushing pressure 20 is lowered or removed to send back the recording medium 9 in direction of arrow *30a*, whereby the end of the aforesaid hot-melt material film 12 is led to the thermal recording heat 10 portion.

On the other hand, the thermal transfer recording sheet 6 is further subjected to finely controlled sheet sending in direction of arrow 31 to lead the end of the thermal transfer recording layer 5 to the recording head 10 portion.

Thus, in the condition where as described above, the hot-melt material film 12 and the thermal transfer recording layer 5 are allowed to coincide in position, the film 12 and the layer 5 are pressed against each other by the pushing pressure 20 produced by the mechanism 21. While again carrying out the rotation 32, the paper sending *30b* and the sheet sending 31, the thermal transfer recording layer 5 is selectively subjected to temperature-raise recording control by means of desired modulated recording signals given from the circuit 11. In the condition where the recording medium 9 and the thermal transfer recording sheet 6 are separated from each other, a monochromatic thermal transfer image formed with the recording material 4 is obtained on the recording medium surface *9a* having the hot-melt material film 12.

Needless to say, when the thermal transfer coating layer 3 contains ink transfer adjusting particles 7, at least a part of the particles 7 are also transferred together with the hot-melt material 2 to be contained in the material film 12.

That is to say, as the thermal transfer recording sheet 6 shown in FIG. 4, there can similarly be used in addition, as previously described in FIG. 2, one in which a thermal transfer coating layer 3 composed of a hot-melt material 2 and ink transfer adjusting particles 7 incorporated into said material and a thermal transfer recording layer 5 composed of a recording material 4 are formed alternately in the longitudinal direction of the sheet-like heat-resistant substrate 1; one in which a thermal transfer coating layer 3 composed of a hot-melt material 2 alone and a thermal transfer recording layer 5 composed of a recording material 4 and ink transfer helping particles 8 incorporated into the recording material 4 are formed alternately in the longitudinal direction of a sheet-like heat-resistant substrate 1; and one in which a thermal transfer coating layer 3 containing ink transfer adjusting particles 7 and a thermal transfer recording layer 5 containing ink transfer helping particles 8 are formed alternately in the longitudinal direction of a sheet-like heat-resistant substrate 1. For example, in transfer recording using the thermal transfer recording sheet in Constitution Example 1, a good record having a recording density of about 1.5 (as measured by means of Macbeth reflective type densitometer RD 914, a trade name, of Kollmorgen Co.) and showing little dot omission was obtained by using a thermal head 10 having a resolution of 4 dots/mm, applying an electric power of 0.3 W/dot and using the aforesaid woodfree paper as the recording medium 9.

Further, by use of the thermal transfer recording sheet 6 in Constitution Example 2, transfer recording was conducted at 33.3 msec/line in the direction of sub scanning (in the longitudinal direction of the thermal transfer recording sheet 6) by using the aforesaid thermal head 10, applying an electric power of 0.6 W/dot, and modulating the pulse duration supplied from the temperature-raise control driving circuit 11 between 0 and 4 msec. In this case, synthetic paper (YUPO FPG #150, a tradename, of Oji Yuka Synthetic Paper Co., Ltd.) was used as the recording medium 9. When the recording material 4 was directly transferred and recorded, as usual, onto the surface *9a* of the recording medium 9, the recording density could have a graduation only between 0.9 to 1.3 (as measured by means of the aforesaid densitometer). However, according to the thermal transfer method for recording of this invention, intermediate tone recording can be conducted at a recording density of between 0.3 and 1.3 and according to the pulse duration supplied from the temperature-raise control driving circuit 11 to the thermal head 10.

This example shows the production of a record by single thermal transfer of the recording material 4, but also when in order to conduct a plurality of thermal transfer recording of the recording material 4, namely, repetitive transfer recording, there is used, for example, for color recording, a thermal transfer recording sheet 5 having three thermal transfer recording layers 5 containing coloring materials of cyan, magenta and yellow type colors, respectively, which are the three primary colors, the thermal transfer coating layer 3 is first subjected to temperature-raise recording control, whereby the hot-melt material 2 and the ink transfer adjusting particles 7 are thermally transferred onto the surface *9a* of the recording medium 9.

Figure 5:
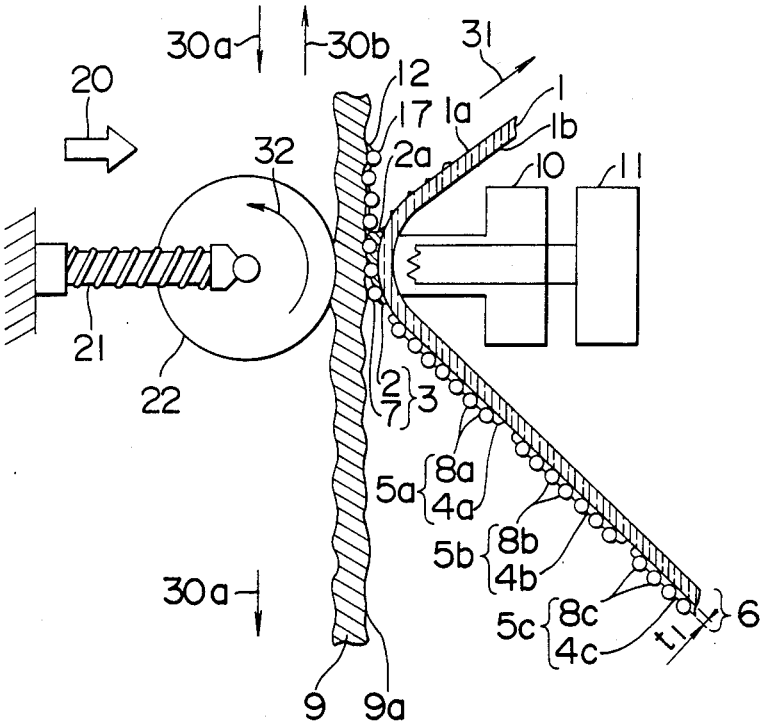
FIG. 5 is a cross-sectional constitutional view showing another example of the thermal transfer method for recording of this invention.

Another example of the thermal transfer method for recording of this invention in the case of conducting this repetitive recording is shown in FIG. 5.

In FIG. 5, as the thermal transfer recording sheet 6, there is used one in which as previously described in FIG. 3, a thermal transfer coating layer 3 composed of a hot-melt material 2 prepared by incorporating thereinto ink transfer adjusting particles and thermal transfer recording layers *5a*, *5b* and *5c* composed of recording materials *4a*, *4b* and *4c*, respectively, containing ink transfer helping particles *8a*, *8b* and *8c*, are placed successively in picture frame sequence along the surface in the longitudinal direction of the sheet-like heatresistant substrate 1.

In the thermal transfer recording in this example, in the same manner as previously described in FIG. 4, the thermal transfer coating layer 3 is first subjected to temperature-raise recording control at a definite temperature (heating energy) by means of a thermal head 10 placed in contact with the reverse side *1b* of the sheet-like substrate 1, whereby the hot-melt material *2a* having a lowered viscosity is transferred to the recording medium surface *9a*, and at the same time, the ink transfer adjusting particles 7 dispersed in the hot-melt material *2a* having a lowered viscosity are also transferred thereto. In this case, a uniform unevenness is formed on the surface *9a* by the transferred ink transfer adjusting particles 17 and hot-melt film 12 which are materials for the thermal transfer coating layer 3, at least over the portion of the desired recording image-plane size and according to individual recording picture elements.

Subsequently, the end of the hot-melt material film 12 containing the aforesaid transferred ink transfer adjusting particles 17 is led to the thermal head 10 portion in direction of arrow 30*a*, and the end of the thermal transfer recording layer 5*a* is also led to the thermal head 10 portion in direction of arrow 31. In the condition where the hot-melt material film 12 containing the ink transfer adjusting particles 17 on the recording medium and the thermal transfer recording layer 5*a* of the thermal transfer recording sheet 6 are allowed to coincide in position, selective temperature-raise recording control is carried out through the thermal head 10 by means of a temperature-raise control driving circuit 11. In this case, the recording medium 9 and the thermal transfer sheet 6 are pressed against each other by means of a pushing pressure 20 produced by a mechanism 21, and rotation 32, paper sending 30*b* and sheet sending 31 are conducted. After the temperature-raise recording, the recording medium 9 and the thermal transfer recording sheet 6 are separated from each other, whereby the thermal transfer recording onto the recording medium 9 is completed for the thermal transfer recording layer 5*a*, as previously described in FIG. 4. The procedure to this point is the same as with FIG. 4.

However, in this example, there are the thermal transfer recording layers 5*b* and 5*c* to be successively subjected to repetitive thermal transfer recording; therefore also in the subsequent thermal transfer recordings of the thermal transfer recording layers 5*b* and 5*c*, as in the thermal transfer recording of the themal transfer recording layer 5*a*, there are repeated leading the ends of the hot-melt material film 12 containing the ink transfer adjusting particles 17 on the surface 9*a* and the thermal transfer recording layers 5*b* and 5*c* and allowing them to coincide in position, and desired selective thermal transfer recording is repeated in the order as 5*b* and 5*c* by the recording head 10.

Accordingly, one record is obtained by conducting repetitive recording by successively repeating thermal transfer on the surface 9*a* of the same recording medium 9 4 times in all, starting with the thermal transfer of the thermal transfer coating layer 3, then in the order as the thermal transfer recording layers 5*a*, 5*b* and 5*c*.

A color record according to the three primary colors method can be obtained by using coloring materials of each of the three primary colors, i.e., cyan, magenta and yellow type colors as coloring materials of the recording materials 4*a*, 4*b* and 4*c* contained in the theraml transfer recording layers 5*a*, 5*b* and 5*c*, respectively, of the thermal transfer recording sheet 6.

Further, when a thermal transfer recording layer using a recording material containing, for example, a coloring material of blackish color is used and four thermal transfer recording layers are present, thermal transfer recording is further repeated again. Thus, one transfer record is obtained by five thermal transfer in all, inclusive of the thermal transfer from the thermal transfer coating layer 3. The order of transfer recordings of the colors in these color recordings can be properly selected.

In the thermal transfer recording sheet 6 shown in FIG. 5, as shown in FIG. 5, all of the thermal transfer recording layers 5*a*, 5*b* and 5*c* contain ink transfer helping particles 8*a*, 8*b* and 8*c*, respectively, and the thermal transfer coating layer 3 contains ink transfer adjusting particles 7. These may be subjected to other modifications. That is to say, there can be used either a thermal transfer recording sheet in which a thermal transfer coating layer 3 containing ink transfer adjusting particles and a plurality of thermal transfer recording layers at least one of which contains no ink transfer helping particle, are placed successively in picture frame sequence along the surface in the longitudinal direction of a sheet-like heat-resistant substrate 1; or a thermal transfer recording sheet in which a thermal transfer coating layer 3 containing no ink transfer adjusting particle 7 and a plurality of thermal transfer recording layers none of which contain any ink transfer helping particle or at least one of which contain ink transfer helping particles, are placed successively in picture frame sequence along the surface in the longitudinal direction of a sheet-like heat-resistant substrate 1. In the case of these thermal transfer recording sheets, repetitive recording by thermal transfer is conducted the same number of times as the number of thermal transfer recording layers placed successively along the surface.

As one example according to FIG. 5, thermal transfer recording by modulation of pulse duration (0 to 4 msec) was conducted under the same recording conditions as in Construction Example 2 by applying an electric power of 0.6 W/dot, and by using, for example, the thermal transfer recording sheet of Constitution Example 3 and the thermal head 10 previously described in FIG. 4. In this case, the three thermal transfer recording layers contained each of coloring materials of one color, i.e., cyan, magenta or yellow type color which were the three primary colors and contained ink transfer helping particles 8*a*, 8*b* and 8*c*, respectively. Therefore, good gradation recording could be achieved for each color, so that when repetitive recording was conducted in the order as cyan, magenta and yellow according to the present thermal transfer method for recording, there was achieved thermal transfer recording of 16 or more gradations in which all the color were stable even at the time of the repetitive recording. Further, in each of color recordings of cyan, magenta and yellow type colors, each of intermediate tone recordings can be conducted at color recording density of between 0.03 and about 1.4 according to the place duration supplied from the temperature-raise control driving circuit 11 to the thermal head 10. Thus, a good full-color recording image was obtained.

In FIG. 5, all the ink transfer adjusting particles 7 contained in the thermal transfer coating layer 3 are transferred onto the recording material surface 9*a* to become the ink transfer adjusting particles 17 on the recording medium, but it is also possible to transfer only a part of the ink transfer adjusting particles 7 by temperature-raise control by means of the temperature-raise control driving circuit 11. In FIG. 4, the hot-melt material film 12 covers a part of the recording medium, but the whole of the recording medium surface 9*a* on which the recording material 4 is at least recorded can be covered similarly by temperature-raise control of by means of the temperature-raise control driving circuit 11.

In the two examples shown in FIG. 4 and FIG. 5, there is shown a case where the thermal transfer coating layer 3 is formed on the same thermal transfer recording sheet 6 as with the thermal transfer recording layers 5, 5*a*, 5*b*, 5*c* and the like, but the surface 9*a* of the recording medium 9 can be coated with the hot-melt material 12 and the ink transfer adjusting particles 17 by use of another thermal transfer sheet in which the thermal transfer coating layer 3 alone is formed on the surface of another sheet-like heat-resistant substrate, by carrying out transfer from the thermal transfer coating layer 3 by another temperature-raise recording control by means of a heat roller or the like before the thermal transfer recording layer 5 is transferred and recorded.

Further, although a linear type thermal recording head 10 is used in the present example, thermal transfer recording can be similarly conducted also by temperature-raise recording control by means of a serial type head such as a serial thermal recording head.

As described above, when the thermal transfer recording sheet and the thermal transfer method for recording of this invention are employed, there can be realized recording having only slight transfer unevenness and a good sensitivity which has been impossible for conventional thermal transfer recording, and moreover, intermediate tone recording which has been impossible for conventioal thermal transfer recording sheets can be realized by using the same recording material. As a result, a transfer recording having a high image quality can be obtained for binary density recording, intermediate tone recording and color recording images. Therefore, the industrial effects of said recording sheet and method for recording are very great.

What is claimed is:

1. A thermal transfer recording sheet comprising an upper surface, said upper surface including a sheet-like heat-resistant substrate on which is provided successively along said upper surface: (a) at least one thermal transfer recording layer, said thermal transfer recording layer containing a binder material and a coloring material, wherein the viscosity of said thermal transfer recording layer lowers with rising of temperature and whereby transferability of said thermal transfer recording layer to a recording medium is imparted, and (b) a thermal transfer coating layer containing a hot-melt material layer which is miscible with at least a part of said binder material.

2. A thermal transfer recording sheet according to claim 1, wherein said thermal transfer coating layer has an uneven surface formed by incorporating into said hot-melt material layer ink transfer adjusting particles having a melting or softening point higher than that of said hot-melt material layer and having a particle diameter greater than the thickness of said hot-melt layer.

3. A thermal transfer recording sheet according to claim 1 or 2, wherein said at least one thermal transfer recording layer has an uneven surface formed by incorporating into said thermal trasnfer layer ink transfer helping particles having a melting or softening point higher than that of said thermal transfer recording layer and having a particle diameter greater than the thickness of said thermal transfer recording layer.

4. A method for thermal transfer recording comprising: (a) providing a thermal transfer recording sheet, said sheet comprising an upper surface, said upper surface including a sheet-like heat-resistant substrate on which are provided successively along said upper surface (1) at least one thermal transfer recording layer, said thermal transfer recording layer containing a binder material and a coloring material, wherein the viscosity of said thermal transfer recording layer lowers with rising of temperature, and whereby transferability of said thermal transfer recording layer to a recording medium is imparted, said recording medium having an upper surface and (2) a thermal transfer coatin layer containing a hot-melt material layer which is miscible with at least a part of said binder material; (b) subjecting said thermal transfer coating layer to a selective temperature-raise recording control to conduct thermal transfer of said hot-melt material layer from said thermal transfer coating layer to said recording medium thereby to coat at least a part of said upper surface of said recording medium to which said recording material is to be transferred, and; (c) subjecting said thermal transfer recording sheet to said selective temperature raise recording control by controlling the quantity of heat applied from said sheet-like heat-resistant substrate to conduct thermal transfer recording of said recording material from said thermal transfer recording layer to at least the whole or a part of the surface portion of said recording medium to which said hot melt material layer has been transferred.

5. A method for thermal transfer recording according to claim 4, wherein said thermal transfer coating layer has an uneven surface formed by incorporating into said hot-melt material layer ink transfer adjusting particles having a melting or softening point higher than that of said hot-melt material layer and having a particle diameter greater than the thickness of said hot-melt material layer, and wherein a part of said ink transfer adjusting particles are thermal transferred together with said hot-melt material layer at the time of thermal transfer of said hot-melt material layer to said recording medium by subjecting said thermal transfer coating layer to said temperature-raise recording control, whereby at least the part of said upper surface of said recording medium to which said recording material is to be transferred is coated with said hot-melt material and said ink transfer adjusting particles.

6. A method for thermal transfer recording according to claim 4 or 5, wherein said at least one thermal transfer recording layer has an uneven surface formed by incorporating into said thermal transfer recording layer ink transfer helping particles having a melting or softening point higher than that of said thermal transfer recording material and having a particle diameter greater than the thickness of said thermal transfer recording layer.

* * * * *